US010294811B2

(12) United States Patent
Morrill

(10) Patent No.: US 10,294,811 B2
(45) Date of Patent: May 21, 2019

(54) ROTOR TIP CLEARANCE

(71) Applicant: ROLLS-ROYCE plc, London (GB)

(72) Inventor: Daniel L Morrill, Nottingham (GB)

(73) Assignee: ROLLS-ROYCE plc, London (GB)

( * ) Notice: Subject to any disclaimer, the term of this patent is extended or adjusted under 35 U.S.C. 154(b) by 401 days.

(21) Appl. No.: 15/220,960

(22) Filed: Jul. 27, 2016

(65) Prior Publication Data

US 2017/0138212 A1 May 18, 2017

(30) Foreign Application Priority Data

Aug. 21, 2015 (GB) ..... 1514896.8

(51) Int. Cl.

| | |
|---|---|
| ***F01D 11/12*** | (2006.01) |
| ***F04D 29/64*** | (2006.01) |
| ***F01D 11/24*** | (2006.01) |
| ***F01D 25/24*** | (2006.01) |
| ***F04D 29/58*** | (2006.01) |

(Continued)

(52) U.S. Cl.

CPC ..... *F01D 11/22* (2013.01); *F01D 11/20* (2013.01); *F01D 11/24* (2013.01); *F01D 21/003* (2013.01); *F01D 25/24* (2013.01); *F04D 29/164* (2013.01); *F04D 29/526* (2013.01); *F04D 29/584* (2013.01); *F04D 29/642* (2013.01); *F04D 27/001* (2013.01); *F05D 2220/32* (2013.01); *F05D 2260/30* (2013.01);

(Continued)

(58) Field of Classification Search

CPC ..... F01D 11/14; F01D 11/20; F01D 11/22; F01D 11/24; F01D 21/003; F01D 429/642

See application file for complete search history.

(56) References Cited

U.S. PATENT DOCUMENTS 4,856,272 A 8/1989 Putman et al.
8,321,104 B2 * 11/2012 Mahmood ..... F01D 11/24 701/100

(Continued)

FOREIGN PATENT DOCUMENTS

EP 1860281 A2 11/2007
GB 2068470 A * 8/1981 ..... F01D 11/22
GB 2 351 361 A 12/2000

OTHER PUBLICATIONS

Dec. 19, 2016 Search Report issued in European Patent Application No. 16 18 1409.

(Continued)

*Primary Examiner* — Jason D Shanske
*Assistant Examiner* — John S Hunter, Jr.
(74) *Attorney, Agent, or Firm* — Oliff PLC

(57) ABSTRACT

A method of calibrating a rotor tip clearance arrangement that includes measuring a rotor parameter indicative of rotor efficiency and altering a position of a tip clearance control actuator by an increment to reduce the rotor tip clearance. The method further includes iterating the measuring and altering, and calculating a rate of change of the rotor parameter between pairs of iterations. The method further includes identifying a knee point where the rate of change of the rotor parameter changes and record the corresponding tip clearance control actuator position as a calibrated position. Also included is a rotor tip clearance arrangement calibrated by the method and a method of monitoring deterioration of a rotor tip clearance arrangement.

4 Claims, 3 Drawing Sheets

(51) Int. Cl.

| | |
|---|---|
| ***F04D 29/52*** | (2006.01) |
| ***F04D 29/16*** | (2006.01) |
| ***F01D 11/20*** | (2006.01) |
| ***F01D 21/00*** | (2006.01) |
| ***F01D 11/22*** | (2006.01) |
| *F04D 27/00* | (2006.01) |

(52) U.S. Cl.
CPC ..... *F05D 2260/80* (2013.01); *F05D 2270/44* (2013.01); *F05D 2270/62* (2013.01); *F05D 2270/66* (2013.01)

(56) References Cited

U.S. PATENT DOCUMENTS

| | | | | |
|---|---|---|---|---|
| 2012/0296593 | A1* | 11/2012 | Seccombe ..... | F01D 11/14 702/94 |
| 2014/0321982 | A1 | 10/2014 | Hafner | |

OTHER PUBLICATIONS

Jan. 26, 2016 Search Report issued in British Patent Application No. 1514896.8.

* cited by examiner

ROTOR TIP CLEARANCE

BACKGROUND

The present disclosure concerns a method of calibrating a rotor tip clearance arrangement. It also concerns a rotor tip clearance arrangement calibrated using the method and a gas turbine engine including such a rotor tip clearance arrangement. It also concerns a method of monitoring deterioration of a rotor tip clearance arrangement.

A rotor, for example a turbine or compressor stage in a gas turbine engine, typically includes blades which extend from a hub. Each blade has a tip distal to the hub. An annular rotor casing surrounds the tips of the blades with a small running clearance between the tips and the casing. A rotor is more efficient if the tip clearance is minimised, so that the maximum amount of air approaching the rotor is passed over the aerofoil surfaces of the blades rather than leaking over the tips. However, a small clearance is required to prevent any of the tips rubbing against the casing and thereby eroding either or both components.

During use of the rotor the tip clearance may change, for example through differing rates of thermal and centrifugal growth, damage to or deterioration of the rotor or casing, and accretion of deposits on the rotor or casing. A rotor tip clearance arrangement is typically provided to control the tip clearance during use of the rotor. Such arrangements generally include a tip clearance control actuator.

Known rotor tip clearance arrangements include air flow valves which direct cooling air onto the casing to retard its thermal growth or to cause it to shrink towards the blade tips. Other known rotor tip clearance arrangements include mechanical actuators to move the casing, or segments mounted to the interior thereof, towards or away from the blade tips. Mechanical actuators may be controlled by electrical or electronic actuators.

SUMMARY

According to a first aspect of the invention there is provided a method of calibrating a rotor tip clearance arrangement, comprising steps to:

a) measure a rotor parameter indicative of rotor efficiency;
b) alter a position of a tip clearance control actuator by an increment to reduce the rotor tip clearance;
c) iterate steps a) and b) and calculate a change of the rotor parameter between pairs of iterations;
d) identify a knee point where the change in the rotor parameter changes and record the corresponding tip clearance control actuator position as a calibrated position.

Advantageously the method enables more accurate control of the rotor tip clearance because the arrangement is better calibrated.

The method may further comprise a step to apply an offset to an open loop control of the tip clearance control actuator that is proportional to the calibrated position. Advantageously this optional step compensates for deterioration of the calibrated position of the actuator.

The increments in iterations of step b) may be equal. The increments in iterations of step b) may not be equal.

The method may further comprise a step before step a) comprising operating the rotor in a steady state condition. Advantageously no effects on the rotor parameter will be due to anything except the increments applied in step b). The method may further comprise repeating the steps of the method;

calculating an average knee point; and recording the corresponding average tip clearance control actuator position as an average calibrated position. Advantageously this repetition and averaging smoothes data anomalies.

A method of monitoring deterioration of a rotor tip clearance arrangement comprises steps to:

a) perform the method as described above at a first time instance;
b) perform the method as described above at a second time instance; and
c) compare the calibration position at the second time instance to the calibration position at the first time instance to determine deterioration of the rotor tip clearance arrangement.

Advantageously the method permits monitoring of deterioration during running of the rotor tip clearance arrangement and therefore allows any deterioration to be compensated or managed.

The rotor parameter may comprise any one or a combination of: rotor speed; turbine temperature; engine temperature; engine pressure; engine fuel flow.

In another aspect of the present invention there is provided a rotor tip clearance arrangement calibrated by the method described above.

In another aspect of the present invention there is provided a gas turbine engine having a rotor tip clearance arrangement calibrated by the method described above. The rotor may be a turbine or a compressor.

The tip clearance control actuator may comprise a cooling flow valve; a casing actuator; or a segment actuator.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

BRIEF DISCRIPTION OF THE DRAWINGS

Embodiments will now be described by way of example only, with reference to the figures, in which.

DETAILED DESCRIPTION

Figure 1:
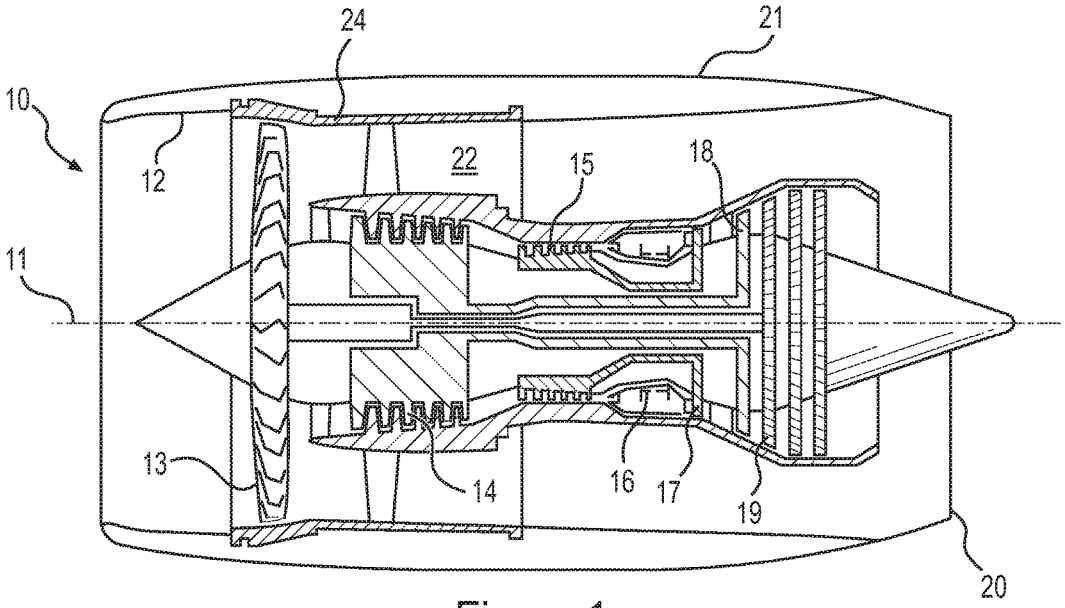
Figure 1 Related Art
FIG. 1 is a sectional side view of a gas turbine engine.

With reference to FIG. 1, a gas turbine engine is generally indicated at 10, having a principal and rotational axis 11. The engine 10 comprises, in axial flow series, an air intake 12, a propulsive fan 13, an intermediate pressure compressor 14, a high pressure compressor 15, combustion equipment 16, a high pressure turbine 17, and intermediate pressure turbine 18, a low pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high pressure compressor 15 is directed into the combustion equipment 16 where it is mixed with fuel and the mixture combusted. The resultant hot combustion products then expand through, and thereby drive the high, intermediate and low pressure turbines 17, 18, 19 before being exhausted through the nozzle 20 to provide additional propulsive thrust. The high 17, intermediate 18 and low 19 pressure turbines drive respectively the high pressure compressor 15, intermediate pressure compressor 14 and fan 13, each by suitable interconnecting shaft.

Other gas turbine engines to which the present disclosure may be applied may have alternative configurations. By way of example such engines may have an alternative number of interconnecting shafts (e.g. two) and/or an alternative number of compressors and/or turbines. Further the engine may comprise a gearbox provided in the drive train from a turbine to a compressor and/or fan.

Figure 2:
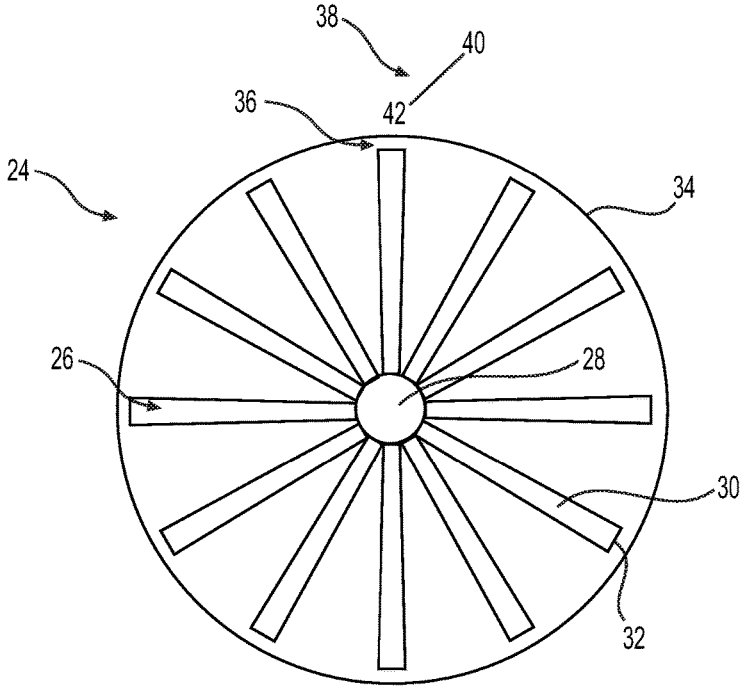
FIG. 2 is a schematic view of a rotor stage.

Each of the fan 13, intermediate pressure compressor 14, high pressure compressor 15, high pressure turbine 17, intermediate pressure turbine 18 and high pressure turbine 19 comprises one or more rotor stages 24. A rotor stage 24 is illustrated in FIG. 2. The rotor stage 24 comprises a rotor 26 which is surrounded by a rotor casing 34. The rotor 26 has a hub 28 from which a plurality of blades 30 extend radially outwardly towards the casing 34. Each blade 30 has a tip 32 at its radially outer extent. There is a tip clearance 36 between each blade tip 32 and the rotor casing 34.

There may be variation in the tip clearance 36 between different ones of the blades 30 of the rotor 26. Zero tip clearance is usually defined as the minimum acceptable running clearance rather than where there is no clearance between the tips 32 and the casing 34. This therefore takes into account any asymmetry or non-concentricity of the rotor 26 and casing 34. It may also accommodate very rapid transients in the respective growth of the rotor blades 30 and the casing 34 which reduce the tip clearance 36 before a rotor tip clearance control arrangement 38 can react to apply control.

The rotor tip clearance control arrangement 38 may include a tip clearance controller 40 and an actuator 42. The controller 40 determines the adjustment required to match the actual tip clearance 36 to a desired tip clearance. The actuator 42 acts according to the control signal generated by the controller 40. The actuator 42 may be a flow control valve to permit a controlled amount of cooling air to be delivered to the rotor casing 34 to control its radial growth. Alternatively it may be an electrical, electronic or mechanical actuator that moves the casing 34 or segments on its radially inner surface to change the tip clearance 36.

In some rotor stages 24 the tips 32 of the blades 30 include sealing fins, a shroud or cooling holes to expel cooling air from the interior of the blade 30. The tips 32 may also include other features, for example tip timing measurement features. The tips 32 may also be formed by an air curtain expelled from the interior of the blades 30 in some rotor stages 24.

The efficiency $\eta$ of a rotor stage 24 is dependent on the tip clearance 36. Where all the fluid flows over the aerofoil surfaces of the blades 30 the work done by the rotor 26 is maximised. Where some of the fluid flows over the blade tips 32 it does no work on the aerofoil surfaces and so reduces the efficiency $\eta$ of the rotor stage 24. In practical rotor stages 24 the efficiency $\eta$ is always less than 100% because there are losses. In particular, as discussed above, zero tip clearance is generally set so there is a small residual clearance 36 to ensure that none of the blade tips 32 can rub against the casing 34 and therefore there is some leakage over the tips 32 of at least the radially shorter blades 30.

The efficiency $\eta$ of the rotor stage 24 is thus related to the tip clearance control applied by the tip clearance control arrangement 38. Thus the efficiency $\eta$ is related to the position of the tip clearance control actuator 42: the degree to which the valve is open in the case of a cooling fluid flow valve, the amount of movement of a mechanical actuator, or the amount of force applied by an electrical or electronic actuator.

Rotor stage efficiency $\eta$ may be calculated from a rotor parameter. The rotor parameter may be, for example, rotational speed of the rotor 26 at a fixed input power. For a turbine stage in a gas turbine engine 10 turbine efficiency $\eta$ is proportional to the turbine speed at a fixed engine condition.

Figure 3:
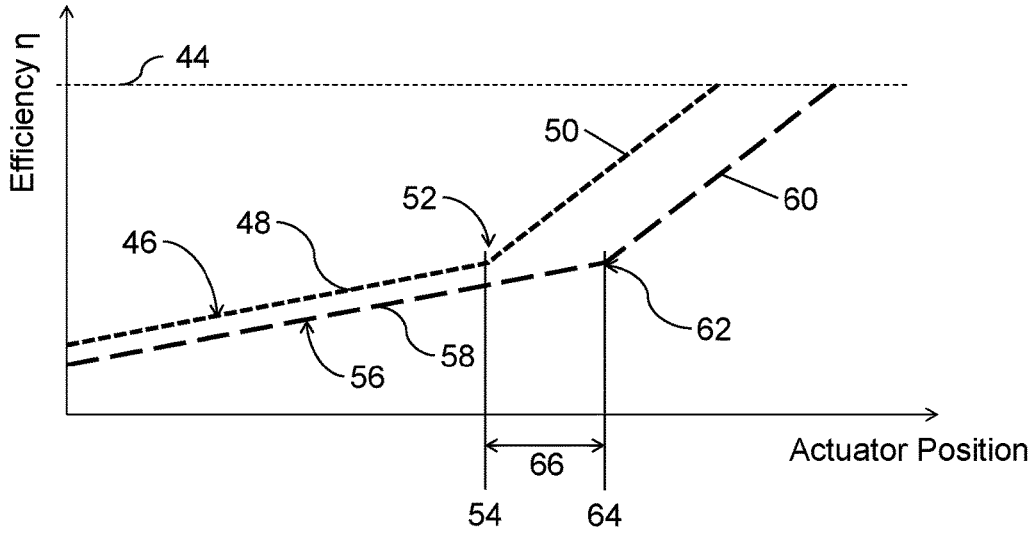
FIG. 3 is a plot of turbine efficiency against tip clearance valve position.

Rotor stage efficiency $\eta$ can be plotted against the position of the actuator 42, as shown in FIG. 3. The optimum efficiency $\eta$ is indicated by dotted line 44 and corresponds to zero tip clearance. The optimum efficiency $\eta$ is less than 100%.

The relationship 46 between efficiency $\eta$ and position of the actuator 42 may be linear or curved and can be expressed as an exchange rate between the position and the efficiency $\eta$. In some rotor stages 24 the relationship 46 between efficiency $\eta$ and position of the tip clearance control actuator 42 exhibits two portions having different exchange rates. In FIG. 3 an exemplary relationship 46 for a new rotor stage 24 is illustrated having a first portion 48 and a second portion 50. The first portion 48 is linear and has an exchange rate illustrated as a first gradient. Similarly, the second portion 50 is linear and has a different exchange rate illustrated as a second gradient.

The first and second portions 48, 50 meet at a knee point 52 which is the point where the exchange rate between the position of the actuator 42 and the efficiency $\eta$ changes abruptly. Mathematically this is the point at which the second order derivative is discontinuous. The position of the actuator 42 corresponding to the knee point 52 of the relationship 46 is a calibrated position 54. The method to calibrate the knee point 52 and consequently the calibrated position 54 is described below.

Through extended and/or repeated use the rotor stage 24 experiences damage, debris accretions and/or degradation which reduces its efficiency $\eta$ for a given input power. An example of the relationship 56 for a deteriorated rotor stage 24 is also illustrated in FIG. 3. The deteriorated relationship 56 also includes a first portion 58 having a first gradient, a second portion 60 having a second gradient and a knee point 62 between them. The position of the actuator 42 corresponding to the deteriorated knee point 62 is calibrated position 64. It can be seen that there is a position offset 66 between the new calibrated position 54 and the deteriorated calibrated position 64. It can also be seen that there is no change in the shape of the relationship lines 46, 56 and that the knee points 52, 62 occur at the same level of efficiency $\eta$.

Advantageously, if the knee point 52 and first and second gradients for the new rotor stage 24 can be identified then the tip clearance 36 can be accurately controlled. This is because the controller 40 is able to apply the correct exchange rate between the measured rotor parameter, for example rotor speed, which is indicative of the rotor efficiency $\eta$ and the required position of the tip clearance actuator 42, for example the amount of cooling air to supply to the casing 30. If the movement of the knee point 52 can be tracked through deterioration of the rotor stage 24 then the tip clearance control arrangement 38 can maintain accurate control of the tip clearance 36 because it can use an accurate deteriorated value of the knee point 62. Specifically the first gradient is applicable for actuator positions up to the deteriorated calibrated position 64 instead of only up to the original calibrated position 54. Thus the offset 66 is added to the calibrated position 54 and the first gradient is used for all the positions of the actuator 42 in this range instead of the second gradient being used for positions of the actuator 42 between the original and deteriorated calibrated positions 54, 64.

Deterioration of a rotor stage 24 takes place over a number of cycles. A cycle may be defined as a single use of the rotor stage 24, for example from stationary through acceleration, steady state operation and deceleration back to stationary. Alternatively a cycle may be defined as a period of use above a specified operating speed. Advantageously it is not necessary to recalibrate the tip clearance control arrangement 38 on every cycle. Instead the recalibration can be scheduled for every n cycles, where n may be in the range 10 to 1000 cycles, preferably 100 to 1000 cycles. The value of n may be dependent on the application of the rotor stage 24 and therefore how aggressive the deterioration is expected to be.

Advantageously because the deterioration of the rotor stage 24 is slow, if it is not possible to recalibrate the tip clearance control arrangement 38 during a cycle it can simply be rescheduled for a subsequent cycle without significant impact on the accuracy. Similarly, the recalibration can be scheduled for more than one consecutive cycles and results averaged so that the trend of the movement of the knee point 52 can be identified. This is advantageous where the conditions required for the calibration method cannot be maintained for a sufficient period to get a precise deteriorated calibrated position 64, for example in a gas turbine engine 10 which is controlled by an auto-throttle in cruise conditions.

Figure 4:
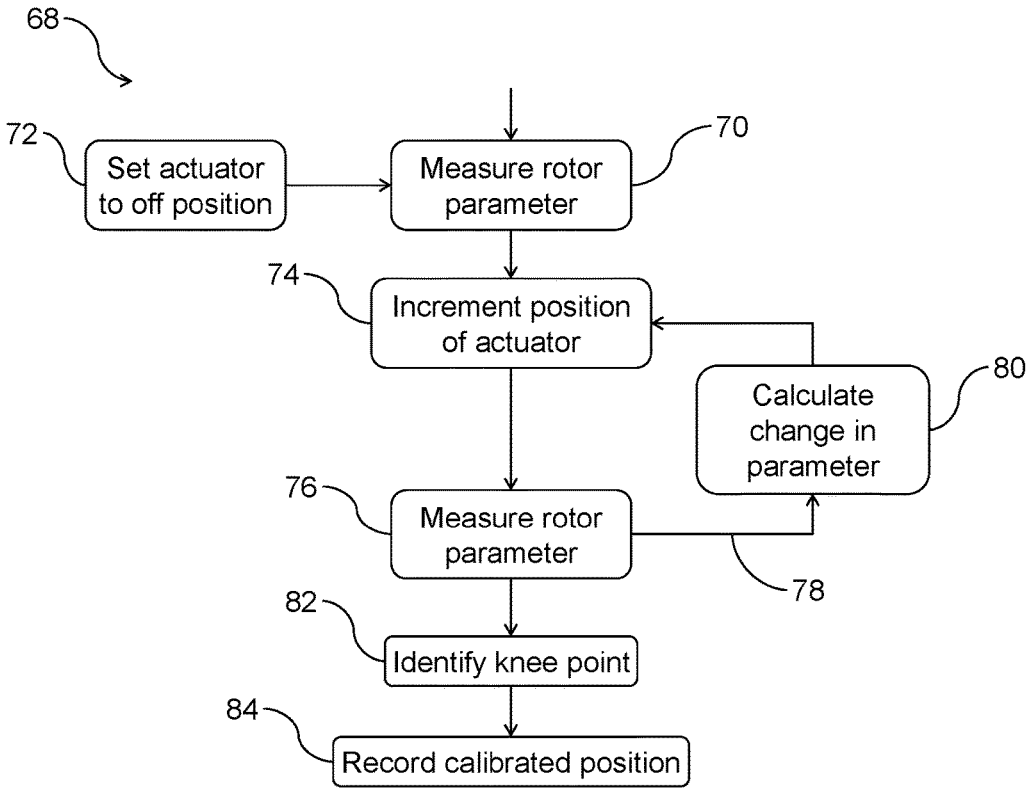
FIG. 4 is a flow chart of the method.

The method 68 to calibrate the tip clearance control arrangement 38 will be described with respect to FIG. 4. In a first step 70 a rotor parameter which is indicative of rotor efficiency η is measured. The measured rotor parameter may be, for example, rotor speed or turbine gas temperature. Alternatively it may be an engine temperature, pressure or fuel flow; or may be a combination of such parameters. The measured rotor parameter is recorded for use in subsequent steps of the method 68.

An optional precursor step 72 is to set the tip clearance control actuator 42 to an off position, by which is meant a position in which the tip clearance 36 is not affected by the tip clearance control arrangement 38 but is solely determined by the operating conditions of the rotor stage 24. Thus where the actuator 42 is a cooling air valve the off position is such that no cooling air is supplied to the casing 30 or, in an arrangement in which a trickle flow is always present, the minimum cooling air flow is supplied only. Where the actuator 42 effects movement of the casing 30 or segments mounted thereto the off position is such that the casing 30 or segments is at the maximum radial extent for the prevalent thermal conditions.

In a second step 74 the position of the actuator 42 is changed by an increment. Thus a flow valve is opened an incremental amount to supply a defined quantity of cooling flow to contract the casing 30 or an actuator moves the casing or segments by a defined radial distance towards the blade tips 32. The increment is preferably set so that multiple increments are possible within the full range of positions of the actuator 42 from off to maximum actuation. The plurality of increments may be of equal sizes or may be unequally sized. For example, consecutive increments of the actuator 42 may supply increasing amounts of cooling air to the casing; or may supply decreasing amounts of cooling air; or may supply otherwise unequal amounts of cooling air. Similarly a mechanical actuator may move the casing 30 or segments by different radial distances in different increments. Unequally sized increments may be beneficial where the casing response to actuation is non-linear so that a measurable change in parameter value is discernible.

The rotor parameter is then measured again, box 76, and its new value recorded. The value of the rotor parameter is different after the actuator position has been incremented because the efficiency η of the rotor stage 24 has been altered by the application of tip clearance control.

In a third step 78 of the method 68 the steps of measuring the rotor parameter 76 and incrementing the actuator position 74 are iterated as shown by iteration loop 78. After each measurement step 76 the change in the rotor parameter is calculated, box 80, and recorded.

Where the relationship between efficiency η and actuator position is linear and follows the first portion 48 or the second portion 50 as illustrated in FIG. 3 the change between consecutively measured pairs of rotor parameters will be constant. However, after a number of iterations of the loop 78 the calculated change of the parameter, box 80, will be different to previous iterations. In subsequent iterations the change of the parameter would then settle to a new constant value which is different to the first constant value.

In a fourth step 82 of the method 68 a knee point 52 of the relationship is identified. The knee point 52 is the point at which the change in the parameter changes from a first constant value to a second constant value. One method to identify the knee point, step 82, is to plot the recorded parameter values against the actuator positions when each was recorded. Then a best fit straight line can be drawn through the points for those with a constant calculated change and a second straight line can be drawn through the points for those with the second constant calculated change. Where the two straight lines intersect is the knee point 52.

The measured parameter itself may be plotted against the incremental positions of the actuator 42. Alternatively the efficiency η of the rotor stage 24 may be determined from the measured parameter, for example rotor speed, and then the efficiency η is plotted against actuator position as shown in FIG. 3. The actuator position corresponding to the knee point 52 is the calibrated position 54 which is recorded, box 84. The calibrated position 54 need not coincide with an incremental position of the actuator 42. The calibrated position 54 may be approximated by identifying the positions to which the actuator 42 was incremented, box 74, between which the change in pairs of parameter measurements altered. Then the calibrated position 54 may be interpolated between these two positions. This is an approximation because the actual calibrated position 54 may not be half way between the two incremental positions of the actuator 42 but may, instead, be closer to one than the other. It will be apparent that it is not necessary to formally identify the knee point 52 in order to determine and record the calibrated position 54 of the actuator 42 if an approximate calibrated position 54 is sufficient.

The method 68 can be repeated during later cycles of use of the rotor stage 24 in order to monitor movement of the calibrated position due to deterioration of the efficiency η of the rotor stage 24. Thus performing the method 68 after a period of use of the rotor stage 24 in which deterioration, damage or debris accretion has occurred may result in the calibrated position 54 being replaced by a deteriorated calibrated position 64, as shown in FIG. 3. Hence the deteriorated calibrated position 64 of the actuator 42 is offset as indicated by double-headed arrow 66 since the first calibration of the rotor tip clearance arrangement 38 using the method.

A method of monitoring the deterioration of a rotor tip clearance arrangement 38 thus comprises a first step to perform the method 68 of calibrating the rotor tip clearance arrangement 38 at a first instance in time. It then comprises second step to perform the method 68 of calibrating the rotor tip clearance arrangement 38 at a second instance in time. Then the calibration positions recorded at the first and second time instances are compared to determine the deterioration of the rotor tip clearance arrangement 38. The deterioration is proportional, or otherwise related to, the position offset 66 between the calibration positions recorded at the first and second time instances.

In a further optional step of the method 68 the tip clearance controller 40 controls the actuator 42 by open loop control. The method 68 applies an offset to the open loop control which is proportional to the calibrated position 54. Thus the offset increases as the calibrated position 54 moves towards the deteriorated calibrated position 64 as the rotor stage 24 efficiency η decreases. The open loop control may be arranged so that the offset is zero when the rotor stage 24 is new, at first configuration, in which case the offset applied to the open loop control is equal to the position offset 66. If an offset is applied in initial calibration, for example because the measured initial calibrated position 54 is not equal to the designed calibration position, the offset applied to the open loop control after deterioration of the rotor stage 24 is the sum of the initial offset and the position offset 66.

It is advantageous to operate the rotor stage 24 in a steady state condition during the method 68. This is because it is then certain that measured changes in the rotor parameter are due to the incremental movement of the actuator 42 and not due to another factor. In particular it is advantageous to allow the rotor stage 24 to settle into steady state again between the first and second time instances so that effects from the first movement of the actuator 42 are not reflected in the measurements for the second time instance. It is also advantageous to operate the rotor stage 24 in a steady state condition immediately before the method 68. This is because any transient effects on the tip clearance 36 from other factors have petered out so there is no residual effect in the measurements taken during the method 68.

It is possible to perform the method 68 whilst the rotor stage 24 is not operating in a steady state condition. For example a rotor stage 24 in a gas turbine engine 10 which is controlled during cruise using an auto-throttle will be subject to small frequent adjustments of the engine power demand in response to changes in air pressure, temperature, speed and direction as the aircraft flies through the air. Although performing the method 68 in a quasi-steady state condition of the rotor stage 24 does not result in as accurate a calibrated position 54, 64 as in a steady state condition, it may be sufficiently accurate to determine a trend of the movement of the calibrated position 54, 64. It is also reasonable to repeat the method 68, for example in consecutive cycles of use of the rotor stage 24, and to average the recorded calibrated positions from the repetitions to obtain an average calibrated position which can be recorded. In accordance with customary practice for averaging data the method may be repeated three times. However, it may be repeated more than three times, or only twice.

The method 68 may be performed as far as box 82 only for each repetition. Then an average knee point can be calculated from which the corresponding average calibrated position is determined. Thus the knee points are averaged rather than the calibrated positions.

As described herein, the rotor tip clearance arrangement 38 has an actuator 42 which is calibrated by the method 68. Deterioration of the arrangement 38 can be monitored by repeating the method 68 at temporally spaced instances and comparing the calibrated positions 54, 64 between the instances.

The actuator 42 may be a cooling flow valve, a casing actuator or a segment actuator. The controller 40 may be implemented in software or hardware. In a gas turbine engine 10 application, the controller 40 may form part of an engine electronic controller or may be separate thereto.

Figure 5:
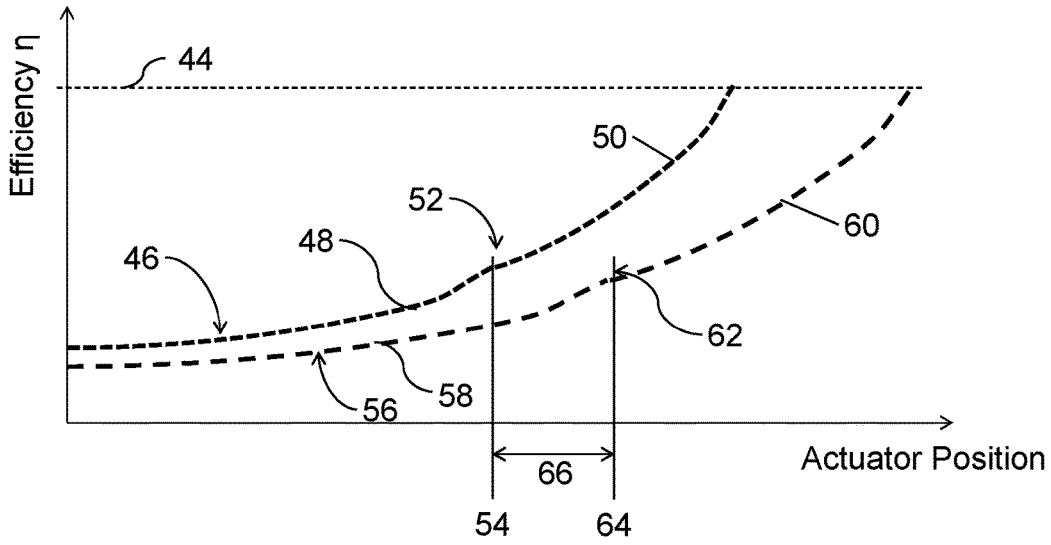
FIG. 5 is a plot of turbine efficiency against tip clearance valve position.

FIG. 5 is similar to FIG. 3 but shows a relationship between rotor efficiency η and actuator position for the initial relationship 46 which is curved in each of the first and second portions 48, 50. The same curves are exhibited in the first and second portions 58, 60 of the deteriorated relationship 56. For example, each of the first 48, 58 portions may be described by a quadratic and each of the second 50, 60 portions may also be described by a quadratic having a different multiplier on the $x^2$ term. The first and second portions 48, 50 of the initial relationship 46 meet at a knee point 52 at which point there is an abrupt change in curve characterised by a change in the rate of change. Similarly the first and second portions 58, 60 of the deteriorated relationship 56 meet at a knee point 62.

Alternatively the portions of the relationship between the efficiency η and actuator position may be described by other non-linear equations. For example, cubic, quartic or a higher order power; exponential; sinusoidal. Alternatively the relationship may be described by any other suitable equation. The first portion 48, 58 may be described by a different equation to the second portion 50, 60.

The relationship between efficiency η and actuator position may be described by a single non-linear equations. For example, cubic, quartic or a higher order power; exponential; sinusoidal. Alternatively the relationship may be described by any other suitable equation. In this case the gradient of the relationship is continuously changing against actuator position and thus the knee point 52, 62 is defined as a threshold gradient. When the gradient equals or exceeds that threshold the corresponding actuator position is recorded as the calibrated position.

Advantageously the rate of deterioration is reduced because the deterioration is actively compensated by applying a calculated offset to the actuator position. Thus optimum clearance may be restored, or at least approached.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The method 68 has been described for a gas turbine engine 10 that powers an aircraft. However, it also has felicity for a rotor stage 24 in a gas turbine engine 10 for an industrial or marine application. The method 68 can be used in other industries where it is beneficial to minimise running clearances between rotors and surrounding static, or rotating, components and in which there is active control of the clearance gap.

The invention claimed is:

1. A method of monitoring deterioration of a rotor tip clearance arrangement comprising steps:

a) at a first time instance, measure a first rotor speed;

b) after measuring the first rotor speed at the first time instance, alter a first position of a tip clearance control actuator comprising a cooling flow valve by a first increment to reduce a first rotor tip clearance;

c) iterate steps a) and b) and calculate a first change of the first rotor speed between pairs of first iterations;

d) after step c), identify a first knee point where the first change in the first rotor speed changes and record a first corresponding tip clearance control actuator position as a first calibrated position;

e) at a second time instance, measure a second rotor speed;

f) after measuring the second rotor speed at the second time instance, alter a second position of the tip clearance control actuator by a second increment to reduce a second rotor tip clearance;

g) iterate steps e) and f) and calculate a second change of the second rotor speed between pairs of second iterations;

h) after step g), identify a second knee point where the second change in the second rotor speed changes and record a second corresponding tip clearance control actuator position as a second calibrated position; and i) compare the second calibration position at the second time instance to the first calibration position at the first time instance to determine deterioration of the rotor tip clearance arrangement.

2. The method as claimed in claim 1, further comprising a step to apply an offset to an open loop control of the tip clearance control actuator, wherein the offset is proportional to either of the first or second calibration positions.

3. The method as claimed in claim 1, further comprising repeating steps a) to d), calculating a first average knee point, and recording a first corresponding average tip clearance control actuator position as a first average calibrated position.

4. The method as claimed in claim 1, further comprising repeating steps e) to h), calculating a second average knee point, and recording a second corresponding average tip clearance control actuator position as a second average calibrated position.

* * * * *